US012035757B2

(12) United States Patent
Xiao et al.

(10) Patent No.: US 12,035,757 B2
(45) Date of Patent: Jul. 16, 2024

(54) ELECTRONIC ATOMIZATION DEVICE, POWER SUPPLY ASSEMBLY AND ATOMIZER

(71) Applicant: Shenzhen Smoore Technology Limited, Shenzhen (CN)

(72) Inventors: Feng Xiao, Shenzhen (CN); Qiang Xu, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 412 days.

(21) Appl. No.: 17/575,641

(22) Filed: Jan. 14, 2022

(65) Prior Publication Data

US 2022/0218040 A1 Jul. 14, 2022

(30) Foreign Application Priority Data

Jan. 14, 2021 (CN) ..... 202120106769.7

(51) Int. Cl.
*A24F 40/57* (2020.01)
*A24F 40/40* (2020.01)

(52) U.S. Cl.
CPC ..... *A24F 40/57* (2020.01); *A24F 40/40* (2020.01)

(58) Field of Classification Search
CPC ..... A24F 40/57; A24F 40/40
USPC ..... 131/329
See application file for complete search history.

(56) References Cited

U.S. PATENT DOCUMENTS

2014/0053858 A1* 2/2014 Liu ..... A24F 40/40 131/329
2014/0360516 A1* 12/2014 Liu ..... A61M 15/06 131/329
2014/0366896 A1* 12/2014 Li ..... A24F 40/40 131/329
2015/0237918 A1* 8/2015 Liu ..... A24F 40/50 429/163
2017/0027221 A1* 2/2017 Liu ..... H02J 7/0044
2017/0071252 A1* 3/2017 Liu ..... A24F 40/40
2017/0325504 A1* 11/2017 Liu ..... A61M 11/042
(Continued)

FOREIGN PATENT DOCUMENTS

CN 211746976 U 10/2020
CN 211746976 U 10/2020
WO 2019192227 A1 10/2019

OTHER PUBLICATIONS

Canada Examination Report, European Application No. 3145533, mailed Apr. 4, 2023 (4 pages).

*Primary Examiner* — Gary F Paumen

(57) ABSTRACT

The application provides an electronic atomization device, a power supply assembly and an atomizer. The electronic atomization device includes an atomizer, a power supply assembly and an elastic element, and the atomizer includes a first magnetic connector. The power supply assembly includes a second magnetic connector. An elastic element disposed between the atomizer and the power supply assembly. According to the working temperature of the atomizer, the first magnetic connector and the second magnetic connector electrically make the power supply assembly with the atomizer being electrically connected, or the elastic element make the atomizer and the power supply assembly being electrically disconnected from each other.

20 Claims, 4 Drawing Sheets

(56) References Cited

U.S. PATENT DOCUMENTS

| | | | | |
|---|---|---|---|---|
| 2018/0160735 | A1* | 6/2018 | Borkovec | A24F 40/60 |
| 2018/0166238 | A1* | 6/2018 | Chen | A24F 40/60 |

* cited by examiner

A-A

ELECTRONIC ATOMIZATION DEVICE, POWER SUPPLY ASSEMBLY AND ATOMIZER

CROSS REFERENCE TO RELATED DISCLOSURES

The present disclosure claims the foreign priority of the Chinese patent disclosure No. 202120106769.7, entitled "ELECTRONIC ATOMIZATION DEVICE, POWER SUPPLY ASSEMBLY AND ATOMIZER" and filed on Jan. 14, 2021 in the China National Intellectual Property Administration, and the entire contents of which are hereby incorporated by reference in their entireties.

TECHNICAL FIELD

The present application relates to the field of atomization technology, and in particular, to an electronic atomization device, a power supply assembly and an atomizer.

BACKGROUND

An electronic atomization device generally includes of an atomizer and a power supply assembly connected with the atomizer. The atomizer is configured to atomize a liquid substance when powered on to form an aerosol for users to suck, and the power supply assembly is configured to supply power to the atomization assembly. The atomization core of the atomizer can atomize the liquid substance into aerosol, the atomization core is usually made of porous ceramic. Porous ceramic itself has pores and has the functions of conducting and storing liquid, therefore, it is widely used in atomization core.

However, when there is too little liquid substance in the pores of the atomization core, the atomization core is easy to be heated in dry state and form a pungent burning smell. Moreover, the high-temperature heat of the atomization core is transmitted to a housing of the atomizer, which will cause the plastic housing of the atomizer to be hot or even melt, and resulting in poor user experience.

SUMMARY

The application provides an electronic atomization device, a power supply assembly and an atomizer, which is configured to overcome the issue of poor user experience caused by heating in dry state of the atomization core.

In order to overcome the aforementioned technical problems, the first aspect is provided by the present application and includes an atomizer, a power supply assembly, and an elastic element. wherein the atomizer includes a first magnetic connector; the power supply assembly includes a second magnetic connector; the elastic element located between the atomizer and the power supply assembly. According to a working temperature of the atomizer, the first magnetic connector and the second magnetic connector make the power supply assembly and the atomizer being electrically connected, or, the elastic element make the atomizer and the power supply assembly being electrically disconnected from each other.

Furthermore, in response to the working temperature of the atomizer is lower than a threshold temperature, the power supply assembly and the atomizer are electrically connected under the attraction force between the first magnetic connector and the second magnetic connector, so that the elastic element has elastic potential energy; in response to the working temperature of the atomizer is higher than or equal to the threshold temperature, the attraction force between the first magnetic connector and the second magnetic connector is less than the elastic force of the elastic element, and the elastic element releases elastic potential energy, so that the atomizer and the power supply assembly are electrically disconnected from each other; or when the working temperature of the atomizer is lower than or equal to the threshold temperature, the power supply assembly and the atomizer are electrically connected under the attraction force between the first magnetic connector and the second magnetic connector, so that the elastic element have elastic potential energy; in response to the working temperature of the atomizer is higher than the threshold temperature, the attraction force between the first magnetic connector and the second magnetic connector is less than the elastic force of the elastic element, and the elastic element releases the elastic potential energy, so that the atomizer and the power supply assembly are electrically disconnected from each other.

Furthermore, the power supply assembly and the atomizer are connected by the attraction force between the first magnetic connector and the second magnetic connector, so that a first electrode connector of the atomizer is in contact with a second electrode connector of the power supply assembly; in response to the working temperature of the atomizer is higher than or equal to the threshold temperature, the attraction force between the first magnetic connector and the second magnetic connector disappears; the elastic potential energy released by the elastic element pushes the atomizer away from the power supply assembly, so that the first electrode connector of the atomizer is separated from the second electrode connector of the power supply assembly, and the atomizer electrically and the power supply assembly are disconnected from each other.

Furthermore, one end of the power supply assembly configured to connect the atomizer has a first recess, one end of the elastic element is disposed in the first recess, and the other end of the elastic element is in contact with the atomizer.

Furthermore, one end of the atomizer configured to connect the power supply assembly has a second recess, one end of the elastic element is disposed in the second recess, and the other end of the elastic element is in contact with the power supply assembly.

Furthermore, the second recess is an air inlet at the bottom of the mounting base of the atomizer.

Furthermore, the elastic element is a coil spring or a flat spring.

Furthermore, one of the first magnetic connector and the second magnetic connector includes magnet, and the other one of the first magnetic connector and the second magnetic connector includes magnet or iron.

Furthermore, a material of the first magnetic connector is magnet, and a material of the second magnetic connector is iron.

Furthermore, the magnet is selected from the group consisting of a samarium cobalt magnet, a neodymium iron boron magnet, and an aluminum nickel cobalt magnet.

Furthermore, the first magnetic connector extends from an end face of a mounting base of the atomizer configured to connect the power supply assembly to a place near an atomization core of the atomizer.

According to a second aspect, a power supply assembly is provided and includes a second magnetic connector and an elastic element, a second magnetic connector is configured to be connected with a first magnetic connector of an atomizer; an elastic element is configured to be in contact with the atomizer; wherein, according to a working temperature of the atomizer, the first magnetic connector and the second magnetic connector make the power supply assembly and the atomizer being electrically connected, or, the elastic element make the atomizer and the power supply assembly being electrically disconnected from each other.

Furthermore, in response to the working temperature of the atomizer is lower than a threshold temperature, the power supply assembly and the atomizer are electrically connected under the attraction force between the first magnetic connector and the second magnetic connector, so that the elastic element has elastic potential energy; in response to the working temperature of the atomizer is higher than or equal to the threshold temperature, the attraction force between the first magnetic connector and the second magnetic connector is less than the elastic force of the elastic element, and the elastic element releases elastic potential energy, so that the atomizer and the power supply assembly are electrically disconnected from each other.

Furthermore, in response to the working temperature of the atomizer is lower than or equal to the threshold temperature, the power supply assembly and the atomizer are electrically connected under the attraction force between the first magnetic connector and the second magnetic connector, so that the elastic element have elastic potential energy; in response to the working temperature of the atomizer is higher than the threshold temperature, the attraction force between the first magnetic connector and the second magnetic connector is less than the elastic force of the elastic element, and the elastic element releases the elastic potential energy, so that the atomizer and the power supply assembly are electrically disconnected from each other.

Furthermore, the power supply assembly and the atomizer are connected by the attraction force between the first magnetic connector and the second magnetic connector, so that a first electrode connector of the atomizer is in contact with a second electrode connector of the power supply assembly; in response to the working temperature of the atomizer is higher than or equal to the threshold temperature, the attraction force between the first magnetic connector and the second magnetic connector disappears; the elastic potential energy released by the elastic element pushes the atomizer away from the power supply assembly, so that the first electrode connector of the atomizer is separated from the second electrode connector of the power supply assembly, and the atomizer electrically and the power supply assembly are disconnected from each other.

According to a third aspect, an atomizer is provided and includes a first magnetic connector and an elastic element. Wherein, the first magnetic connector is configured to be connected with a second magnetic connector of a power supply assembly; the elastic element is configured to be in contact with the power supply assembly; wherein, according to a working temperature of the atomizer, the first magnetic connector and the second magnetic connector make the power supply assembly and the atomizer being electrically connected, or, the elastic element make the atomizer and the power supply assembly being electrically disconnected from each other.

Furthermore, in response to the working temperature of the atomizer is lower than a threshold temperature, the power supply assembly and the atomizer are electrically connected under the attraction force between the first magnetic connector and the second magnetic connector, so that the elastic element has elastic potential energy; in response to the working temperature of the atomizer is higher than or equal to the threshold temperature, the attraction force between the first magnetic connector and the second magnetic connector is less than the elastic force of the elastic element, and the elastic element releases elastic potential energy, so that the atomizer and the power supply assembly are electrically disconnected from each other.

Furthermore, in response to the working temperature of the atomizer is lower than or equal to the threshold temperature, the power supply assembly and the atomizer are electrically connected under the attraction force between the first magnetic connector and the second magnetic connector, so that the elastic element have elastic potential energy; in response to the working temperature of the atomizer is higher than the threshold temperature, the attraction force between the first magnetic connector and the second magnetic connector is less than the elastic force of the elastic element, and the elastic element releases the elastic potential energy, so that the atomizer and the power supply assembly are electrically disconnected from each other.

Furthermore, the power supply assembly and the atomizer are connected by the attraction force between the first magnetic connector and the second magnetic connector, so that a first electrode connector of the atomizer is in contact with a second electrode connector of the power supply assembly; in response to the working temperature of the atomizer is higher than or equal to the threshold temperature, the attraction force between the first magnetic connector and the second magnetic connector disappears; the elastic potential energy released by the elastic element pushes the atomizer away from the power supply assembly, so that the first electrode connector of the atomizer is separated from the second electrode connector of the power supply assembly, and the atomizer electrically and the power supply assembly are disconnected from each other.

Furthermore, one end of the power supply assembly configured to connect the atomizer has a first recess, one end of the elastic element is disposed in the first recess, and the other end of the elastic element is in contact with the atomizer; or, one end of the atomizer configured to connect the power supply assembly has a second recess, one end of the elastic element is disposed in the second recess, and the other end of the elastic element is in contact with the power supply assembly.

BRIEF DESCRIPTION OF THE DRAWINGS

In order to more clearly illustrate the technical solutions of the embodiments of the present disclosure, the drawings for the description of the embodiment will be described in brief. Obviously, the drawings in the following description are only some of the embodiments of the present disclosure. For a person of ordinary skill in the art, other drawings may be obtained based on the following drawings without any creative work.

DETAILED DESCRIPTION

Figure 1:
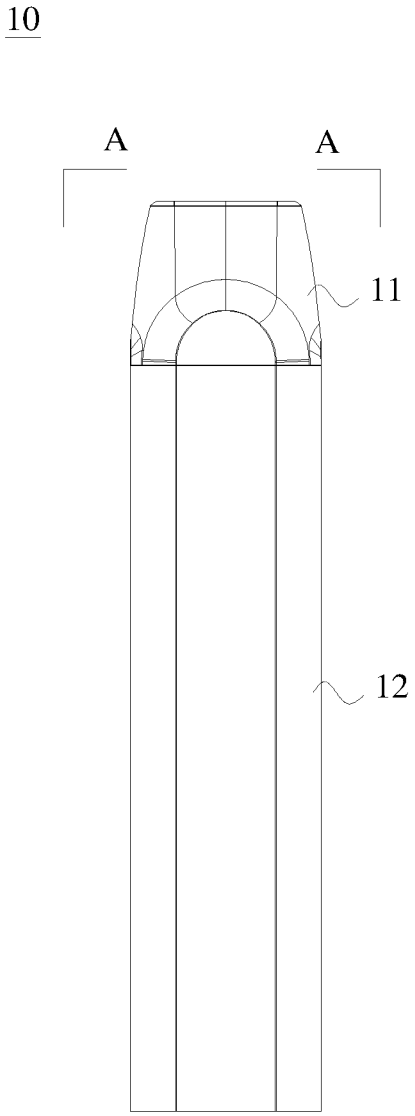
FIG. 1 is a structural schematic view of an embodiment of an electronic atomization device according to the present application.

Technical solutions of the embodiments of the present disclosure will be clearly and comprehensively described by referring to the accompanying drawings. Obviously, the embodiments described herein are only a part of, but not all of, the embodiments of the present disclosure. Based on the embodiments in the present disclosure, all other embodiments obtained by a person of ordinary skill in the art without any creative work shall fall within the scope of the present disclosure.

It should be noted that directional indications if present (such as up, down, left, right, front, back, . . . ) in the embodiments of the present disclosure are only expressed to explain relative positional relationships and movement between components in a particular attitude (as shown in the drawings). When the particular attitude is changed, the directional indications shall also be changed accordingly.

In addition, when using expressions "first", "second", and the like in the embodiment of the present disclosure, the expressions "first", "second", and the like are utilized for descriptive purposes only, and shall not be interpreted as indicating or implying relative importance or implicitly specifying the number of an indicated technical feature. Therefore, features defined by "first" and "second" may explicitly or implicitly include at least one of the such feature. In addition, technical solutions of various embodiments may be combined with each other, but only on the basis that the technical solutions may be achieved by a person of ordinary skill in the art. When combination of technical solutions appears to be contradictory or unachievable, such combination of technical solutions shall be interpreted as inexistence and excluded from the scope of the present disclosure.

The term "comprising" means "including, but not necessarily limited to"; it specifically indicates open-ended inclusion or membership in a so-described combination, group, series and the like. It should be noted that references to "an" or "one" embodiment in this disclosure are not necessarily to the same embodiment, and such references mean at least one. Unless otherwise defined, all technical and scientific terms used herein have the same meaning as a skilled person in the art would understand. The terminology used in the description of the present disclosure is for the purpose of describing particular embodiments and is not intended to limit the disclosure.

The present application is described in detail below in combination with the drawings and embodiments.

The present application is described in detail below in combination with the drawings and embodiments.

Figure 2:
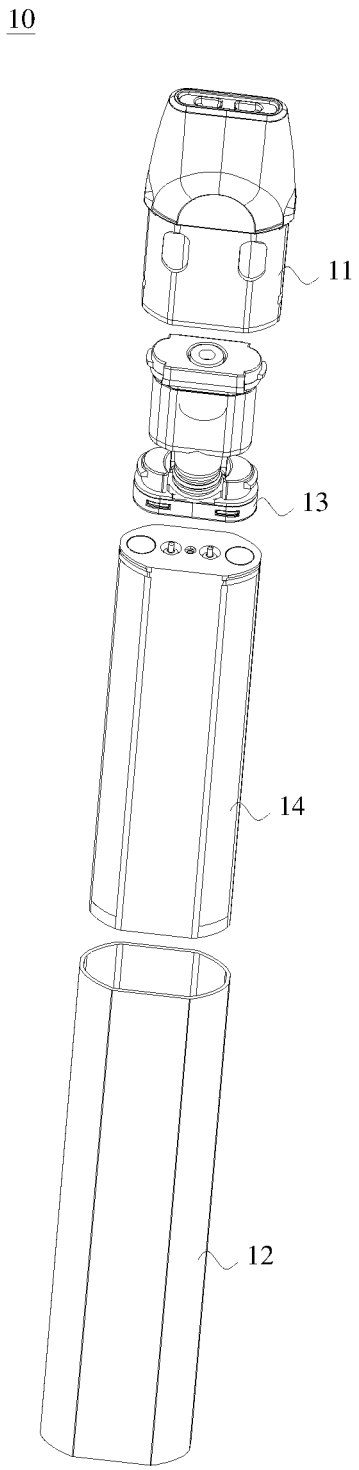
FIG. 2 is a schematic view of the structure of the electronic atomization device shown in FIG. 1 before assembly.
Figure 3:
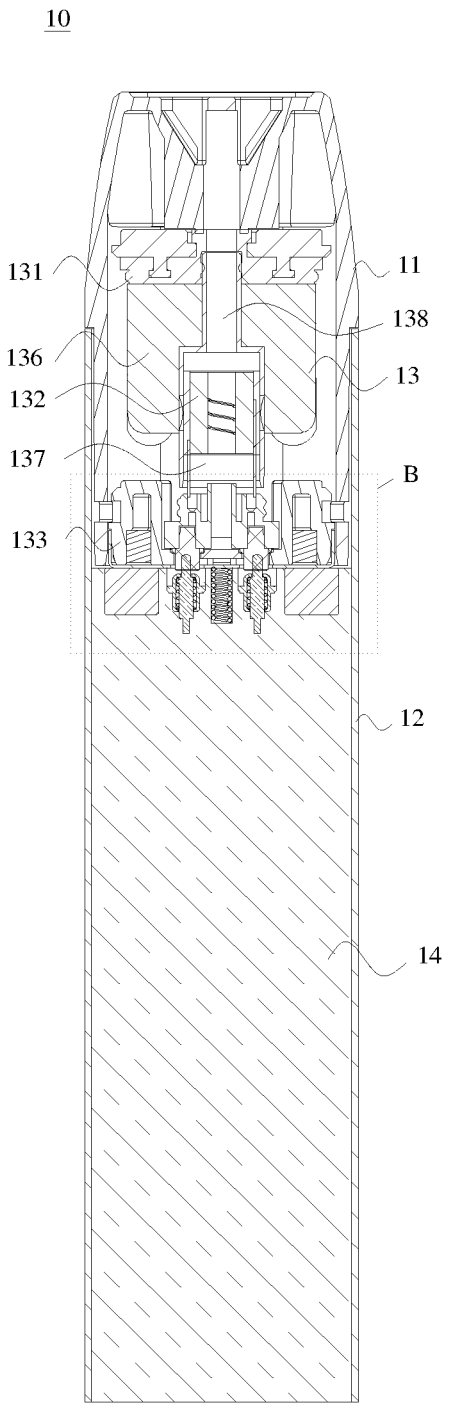
FIG. 3 is a cross-sectional structural view along the A-A direction of the electronic atomization device shown in FIG. 1.

Referring to FIG. 1, FIG. 2, and FIG. 3. FIG. 1 is a structural schematic view of an embodiment of an electronic atomization device according to the present application; FIG. 2 is a schematic view of the structure of the electronic atomization device shown in FIG. 1 before assembly; FIG. 3 is a cross-sectional structural view along the A-A direction of the electronic atomization device shown in FIG. 1. In one embodiment, an electronic atomization device 10 is provided. The electronic atomization device 10 includes an atomization sleeve 11, an atomizer 13, a shell 12 and a power supply assembly 14. The atomization sleeve 11 and the shell 12 are detachably connected.

The atomizer 13 specifically includes a housing 131, an atomization core 132 and a mounting base 133. The housing 131 has a liquid storage chamber 136, a mounting chamber 137, and an air outlet channel 138. The liquid storage chamber 136 and the mounting chamber 137 are communicated through a liquid inlet hole. The air outlet channel 138 is communicated with the mounting chamber 137. The atomization core 132 is disposed in the mounting chamber 137 and covers the liquid inlet hole. The mounting base 133 is located on the side of the atomization core 132 away from the air outlet channel 138.

The atomization sleeve 11 has a mouthpiece, the atomization sleeve 11 is sleeved on the atomizer 13, the mouthpiece is communicated with the air outlet channel 138, and the mounting base 133 is hermetically located in the atomization sleeve 11. The liquid storage chamber 136 is configured to store liquid. The atomization core 132 is used to atomize the liquid entering an atomization chamber of the atomization core 132 from the liquid storage chamber 136 to form an aerosol. The aerosol reaches the mouthpiece through the air outlet channel 138 for the user to suck. The structure of the atomization core 132 is not limited. In one embodiment, the atomization core 132 includes a hollow cylindrical porous ceramic and a heating film.

The power supply assembly 14 is disposed in the shell 12, and power supply assembly 14 and the shell 12 together form the host. The atomizer 13 is inserted into one end port of the shell 12. One end of the atomizer 13 with a mounting base 133 is connected with the power supply assembly 14 in the shell 12. The power supply assembly 14 is configured to supply power to the atomization core 132 in the atomizer 13. When the atomizer 13 needs to be replaced, the atomizer 13 can be separated from the host, and a new atomizer can be installed on the host to realize the recycle of the host.

Figure 4:
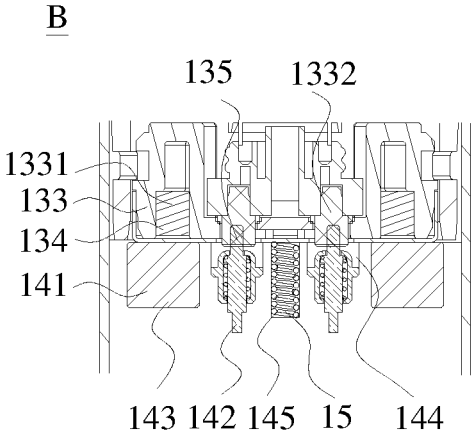
FIG. 4 is an enlarged structural view of part B in FIG. 3.

Referring to FIG. 4, FIG. 4 is an enlarged structural view of B in FIG. 3. In one embodiment, the atomizer 13 also includes a first magnetic connector 134 and a first electrode connector 135. The first magnetic connector 134 and the first electrode connector 135 are disposed at one end of the mounting base 133 of the atomizer 13 facing the power supply assembly 14. Specifically, the end of the mounting base 133 facing the power supply assembly 14 defines a third recess 1331 and a fourth recess 1332 spaced apart from each other. The first magnetic connector 134 is disposed in the third recess 1331, and the first electrode connector 135 is disposed in the fourth recess 1332. In one embodiment, the number of each of the first magnetic connector 134, the first electrode connector 135, the third recess 1331, and the fourth recess 1332 is two. In other embodiments, the number of each of the first magnetic connector 134, the first electrode connector 135, the third recess 1331, and the fourth recess 1332 can be more than two.

The power supply assembly 14 includes a second magnetic connector 141 and a second electrode connector 142. The second magnetic connector 141 and the second electrode connector 142 are disposed at one end of the power supply assembly 14 facing the atomizer 13. Specifically, the end of the power supply assembly 14 facing the atomizer 13 defines a fifth recess 143 and a sixth recess 144 spaced apart from each other. The second magnetic connector 141 is disposed in the fifth recess 143, and the second electrode connector 142 is disposed in the sixth recess 144. In one embodiment, the number of each of the second magnetic connector 141, the second electrode connector 142, the fifth recess 143, and the sixth recess 144 is two. In other embodiments, the number of each of the number of the second magnetic connector 141, the second electrode connector 142, the fifth recess 143, and the sixth recess 144 can be more than two.

In one embodiment, the third recess 1331 is disposed opposite to the fifth recess 143, so that the first magnetic connector 134 and the second magnetic connector 141 can be magnetically attracted. The fourth recess 1332 is disposed opposite to the sixth recess 144, so that the first electrode connector 135 can be electrically connected with the second electrode connector 142. The power supply assembly 14 and the atomizer 13 can be fixed by magnetic attraction between the first magnetic connector 134 and the second magnetic connector 141. Furthermore, the first electrode connector 135 and the second electrode connector 142 are in contact with each other and electrically connected, so that the power supply assembly 14 can supply power to the atomizer 13 and the atomizer 13 can be powered to work.

The material of one of the first magnetic connector 134 and the second magnetic connector 141 is a temperature sensitive magnetic material, and the material of the other one of the first magnetic connector 134 and the second magnetic connector 141 is a magnetic material or iron. In one embodiment, the material of the first magnetic connector 134 is a magnet and the material of the second magnetic connector 141 is iron. In one embodiment, the distance between the first magnetic connector 134 and the atomization core 132 is very short, and the heat released by the atomization core 132 can be soon transmitted to the first magnetic connector 134, thus the first magnetic connector 134 can sense the temperature of the atomization core 132 easily. In one embodiment, the magnetic material can be a temperature sensitive magnet, for example the magnet can be a samarium cobalt (SmCo) magnet, a neodymium iron boron (NdFeB) magnet, or an aluminum nickel cobalt (AlNiCo) magnet. In other embodiments, the material of the first magnetic connector 134 may be iron and the material of the second magnetic connector 141 may be magnet. Alternatively, the material of both the first magnetic connector 134 and the second magnetic connector 141 is magnet. Also, the heat of the atomization core 132 can be transmitted to the first magnetic connector 134 and the second magnetic connector 141 by heat conduction.

In other embodiments, the end of the mounting base 133 close to the power supply assembly 14 can also be provided with an end cover, the end cover can be used as the first magnetic connector 134, namely, the end cover can be used as the first magnetic connector 134 and magnetically attracted with the second magnetic connector 141. The material of the end cover can be magnetic material or iron, and the magnetic material can be magnet, for example the magnet can be a SmCo magnet, a NdFeB magnet, or an AlNiCo magnet. Since the mounting base 133 is used as the first magnetic connector 134, the structure of the atomizer 13 can be simplified, and further the structure of the electronic atomization device 10 is simplified.

One of the first electrode connector 135 and the second electrode connector 142 may be a thimble, and the other one of the first electrode connector 135 and the second electrode connector 142 may be an electrode. The power supply assembly 14 and the atomizer 13 can be electrically connected by contact between the thimble and the electrode. In other embodiments, the first electrode connector 135 and the second electrode connector 142 are not limited to the above elements, and can also be other elements, as long as the electrical connection between the power supply assembly 14 and the atomizer 13 can be realized.

In one embodiment, the electronic atomization device 10 also includes an elastic element 15, and the elastic element 15 is disposed between the atomizer 13 and the power supply assembly 14. Specifically, one end of the power supply assembly 14 close to the atomizer 13 of the embodiment defines a first recess 145. One end of the elastic element 15 is disposed in the first recess 145 and can be fixed in the first recess 145, and the other end of the elastic element 15 is in contact with or connected to the atomizer 13. The elastic element 15 in the first recess 145 can stretch along the axial direction of the elastic element 15.

The elastic element 15 may be a coil spring or a flat spring, or other elastic structure. In the embodiment, the elastic element 15 is described by taking a coil spring as an example.

Generally, the increase of temperature will weaken the magnetism of the magnet, thus the magnetic attraction between the atomizer 13 and the power supply assembly 14 may be weakened. When the working temperature of the atomizer 13 is higher than or equal to a threshold temperature, the temperature is transmitted to the magnet, which may cause the attraction force between the first magnetic connector 134 and the second magnetic connector 141 be weaken or. The threshold temperature can be set as the Curie temperature of the magnet, when the temperature of the magnet is above the Curie temperature of the magnet, the magnet will not be magnetic. Namely, the attraction force between the first magnetic connector 134 and the second magnetic connector 141 will disappear. The Curie temperatures of common magnets are as follows: 60° C.~200° C. for NdFeB magnets, 250° C.~350° C. for SmCo magnets and 450° C.~900° C. for AlNiCo magnets. Different liquid requires different atomization temperature, so different magnets can be selected according to the different liquid substance.

Figure 5:
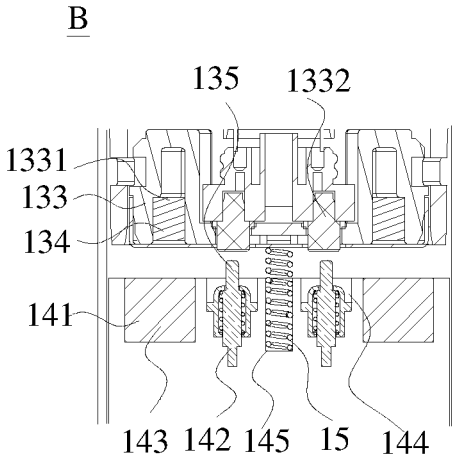
FIG. 5 is a structural schematic view of FIG. 4 when the working temperature of the atomizer is higher than or equal to the threshold temperature.

Referring to FIGS. 4 and 5, FIG. 5 is a structural schematic view of FIG. 4 when the working temperature of the atomizer is higher than or equal to the threshold temperature.

Referring to FIG. 4, when the working temperature of the atomizer 13 is lower than the threshold temperature, the first magnetic connector 134 and the second magnetic connector 141 have a greater magnetism and a stronger attraction force. When the attraction force between the first magnetic connector 134 and the second magnetic connector 141 is greater than or equal to the elastic force of the coil spring, the first magnetic connector 134 and the second magnetic connector 141 are magnetically attracted, namely, the power supply assembly 14 and the atomizer 13 are magnetically attracted, and the coil spring is compressed, so that the coil spring has an elastic potential energy.

Referring to FIG. 5, in one embodiment, when the material of the first magnetic connector 134 is a magnet and the material of the second magnetic connector 141 is iron. When the working temperature of the atomizer 13 is higher than or equal to the threshold temperature, heat of the atomizer 13 is transmitted to the first magnetic connector 134, and the temperature of the first magnetic connector 134 and the second magnetic connector 141 can be increased, the magnetism of the first magnetic connector 134 is weakened and the attraction force is weakened. When the temperature of the first magnetic connector 134 reaches the Curie temperature, the first magnetic connector 134 will lost magnetism, and the attraction force between the first magnetic connector 134 and the second magnetic connector 141 disappears. When the attraction force between the first magnetic connector 134 and the second magnetic connector 141 is less than the elastic force of the coil spring, the coil spring releases the elastic potential energy to push the atomizer 13 away from the power supply assembly 14, so that the first magnetic connector 134 is separated from the second magnetic connector 141. Thus, the atomizer 13 and the power supply assembly 14 are electrically disconnected from each other.

Alternatively, when the working temperature of the atomizer 13 is lower than or equal to the threshold temperature, the first magnetic connector 134 and the second magnetic connector 141 have a greater magnetism and a stronger attraction force. When the attraction force between the first magnetic connector 134 and the second magnetic connector 141 is greater than or equal to the elastic force of the coil spring, the first magnetic connector 134 and the second magnetic connector 141 are magnetically attracted, namely, the power supply assembly 14 and the atomizer 13 are magnetically attracted, and the coil spring is compressed, so that the coil spring has an elastic potential energy. When the working temperature of the atomizer 13 is higher than the threshold temperature, heat of the atomizer 13 is transmitted to the first magnetic connector 134, so that the temperatures of the first magnetic connector 134 and the second magnetic connector 141 are increased, and the magnetism and attraction force between the first magnetic connector 134 are decreased. When the temperature of the first magnetic connector 134 reaches the Curie temperature, the first magnetic connector 134 will lost magnetism, and the attraction force between the first magnetic connector 134 and the second magnetic connector 141 disappears. When the attraction force between the first magnetic connector 134 and the second magnetic connector 141 is less than the elastic force of the coil spring, the coil spring releases the elastic potential energy to push the atomizer 13 away from the power supply assembly 14, so that the first magnetic connector 134 is separated from the second magnetic connector 141. Thus, the atomizer 13 and the power supply assembly 14 are electrically disconnected from each other.

According to the working temperature of the atomizer 13 and the threshold temperature, the first magnetic connector 134 and the second magnetic connector 141 make the power supply assembly 14 and the atomizer 13 being electrically connected, or, the elastic element 15 make the atomizer 13 and the power supply assembly 14 being electrically disconnected from each other.

In other embodiments, for example, the material of the first magnetic connector 134 is iron and the material of the second magnetic connector 141 is magnet. When the working temperature of the atomizer 13 is higher than or equal to the threshold temperature, the heat of the atomizer 13 is transmitted to the first magnetic connector 134, the temperature of the first magnetic connector 134 is increased and the heat of the first magnetic connector 134 is transmitted to the second magnetic connector 141. When the temperature of the second magnetic connector 141 is increased, the magnetism of the second magnetic connector 141 is decreased, and the attraction force between the second magnetic connector 141 is decreased. When the temperature of the first magnetic connector 134 reaches the Curie temperature, the second magnetic connector 141 will lost magnetism, and the attraction force between the first magnetic connector 134 and the second magnetic connector 141 disappears. When the attraction force between the first magnetic connector 134 and the second magnetic connector 141 is less than the elastic force of the coil spring, the coil spring releases the elastic potential energy to push the atomizer 13 away from the power supply assembly 14, so that the first magnetic connector 134 is separated from the second magnetic connector 141. Thus, the atomizer 13 and the power supply assembly 14 are electrically disconnected from each other.

In other embodiments, for example, the material of both the first magnetic connector 134 and the second magnetic connector 141 is magnet. When the working temperature of the atomizer 13 is higher than or equal to the above threshold temperature, the heat of the atomizer 13 is transmitted to the first magnetic connector 134, the temperature of both the first magnetic connector 134 and the second magnetic connector 141 is increased, the temperature of the first magnetic connector 134 and the second magnetic connector 141 are increased, the magnetism of both the first magnetic connector 134 and the second magnetic connector 141 are decreased, and the attraction force between the first magnetic connector 134 and the second magnetic connector 141 are decreased. When the temperature of the first magnetic connector 134 reaches the Curie temperature, the first magnetic connector 134 and the second magnetic connector 141 will lost magnetism, and the attraction force between the first magnetic connector 134 and the second magnetic connector 141 disappears. When the attraction force between the first magnetic connector 134 and the second magnetic connector 141 is less than the elastic force of the coil spring, the coil spring releases the elastic potential energy to push the atomizer 13 away from the power supply assembly 14, so that the first magnetic connector 134 is separated from the second magnetic connector 141. Thus, the atomizer 13 and the power supply assembly 14 are electrically disconnected from each other.

The electronic atomization device has an elastic element 15 compare to prior art. When the temperature of the atomizer 13 is too high due to the atomizer 13 is heated in dry state, charging or other conditions, the elastic element 15 can make the atomizer 13 and the power supply assembly 14 being electrically disconnected from each other, so that the atomizer 13 stop working, thus, the atomizer 13 is prevented from being heated in dry state or abnormal work, and the user's use experience is improved.

When the temperature of the magnet increases, the attraction force of the magnet will decrease, but most of the attraction force will recover after the magnet is cooled. Therefore, when the temperature of the atomizer 13 is too high, the power will be cut off, and after the first magnetic connector 134 and the second magnetic connector 141 being cool down slowly, the attraction force between the first magnetic connector 134 and the second magnetic connector 141 will recover, and the coil spring will be compressed, so that the atomizer 13 and the power supply assembly 14 are electrically connected with each other, and the atomizer 13 can work normally again.

In other embodiments, one end of the atomizer 13 close to the power supply assembly 14 defines a second recess, one end of the elastic element 15 is disposed in the second recess and can be fixed in the second recess, the other end of the elastic element 15 is in contact with or connected to the power supply assembly 14, and the elastic element 15 can stretch along the axial direction in the second recess. The second recess may be a recess disposed at the bottom of the mounting base 133 of the atomizer 13. In one embodiment, the second recess is an air inlet at the bottom of the mounting base 133 of the atomizer 13, thus the structure of the atomizer 13 is simplified.

In other embodiments, the first magnetic connector 134 extends from an end face of the mounting base 133 of the atomizer 13 close to the power supply assembly 14 to a place near the atomization core 132 of the atomizer 13. Specifically, the mounting base 133 of the atomizer 13 includes a base and a fixing part, the fixing part is located on the side of the base away from the power supply assembly 14. The end face of the mounting base 133 close to the power supply assembly 14 defines a third recess 1331, and the third recess 1331 is disposed on the bottom. The third recess 1331 can cross through the base and extends to the fixing part, and the first magnetic connector 134 is disposed in the third recess 1331. When the third recess 1331 cross through the bottom and extends to the fixing part, the first magnetic connector 134 can be closer to the atomization core 132. Since the first magnetic connector 134 is close to the atomization core 132, the heat conduction between the atomization core 132 and the first magnetic connector 134 is faster, thus the first magnetic connector 134 can sense the temperature of the atomization core 132 easily.

A power supply assembly 14 is also provided by the present application, the power supply assembly 14 includes a second magnetic connector 141 and an elastic element 15. The second magnetic connector 141 is configured to connect with the first magnetic connector 134 of the atomizer 13, and the elastic element 15 is configured to be in contact with the atomizer 13.

When the working temperature of the atomizer 13 is lower than the threshold temperature, the attraction force between the first magnetic connector 134 and the second magnetic connector 141 is greater than or equal to the elastic force of the elastic element 15, and the first magnetic connector 134 and the second magnetic connector 141 make the power supply assembly 14 and the atomizer 13 being connected firmly, so that the elastic element 15 has an elastic potential energy. When the working temperature of the atomizer 13 is higher than or equal to the threshold temperature, the attraction force between the first magnetic connector 134 and the second magnetic connector 141 is less than the elastic force of the elastic element 15, and the elastic element 15 releases the elastic potential energy, so that the atomizer 13 from the power supply assembly 14 are electrically disconnected from each other.

Alternatively, when the working temperature of the atomizer 13 is lower than or equal to the threshold temperature, the attraction force between the first magnetic connector 134 and the second magnetic connector 141 is greater than or equal to the elastic force of the elastic element 15, and the first magnetic connector 134 and the second magnetic connector 141 make the power supply assembly 14 and the atomizer 13 being connected firmly, so that the elastic element 15 has elastic potential energy. When the working temperature of the atomizer 13 is higher than the threshold temperature, the attraction force between the first magnetic connector 134 and the second magnetic connector 134 is less than the elastic force of the elastic element 15, and the elastic element 15 releases the elastic potential energy, so that the atomizer 13 from the power supply assembly 14 are electrically disconnected from each other.

According to the working temperature of the atomizer 13 and threshold temperature, the first magnetic connector 134 and the second magnetic connector 141 make the power supply assembly 14 and the atomizer 13 being electrically connected, or, the elastic element 15 make the atomizer 13 and the power supply assembly 14 being electrically disconnected from each other.

When the temperature of the atomizer 13 is too high, the elastic element 15 of the power supply assembly 14 makes the atomizer 13 and the power supply assembly 14 being electrically disconnected from each other, so that the atomizer 13 cannot work normally, thus, the atomizer 13 is prevented from being heated in dry state or abnormal work.

An atomizer 13 is also provided by the present application, the atomizer 13 includes a first magnetic connector 134 and an elastic element 15. The first magnetic connector 134 is configured to connect with the second magnetic connector 141 of the power supply assembly 14, and the elastic element 15 is configured to be in contact with the power supply assembly 14.

When the working temperature of the atomizer 13 is lower than the threshold temperature, the attraction force between the first magnetic connector 134 and the second magnetic connector 141 is greater than or equal to the elastic force of the elastic element 15, and the first magnetic connector 134 and the second magnetic connector 141 make the power supply assembly 14 and the atomizer 13 being electrically connected, so that the elastic element 15 has elastic potential energy. When the working temperature of the atomizer 13 is higher than or equal to the threshold temperature, the attraction force between the first magnetic connector 134 and the second magnetic connector 141 is less than the elastic force of the elastic element 15, and the elastic element 15 releases the elastic potential energy, the atomizer 13 and the power supply assembly 14 being electrically disconnected from each other.

When the working temperature of the atomizer 13 is lower than or equal to the threshold temperature, the attraction force between the first magnetic connector 134 and the second magnetic connector 141 is greater than or equal to the elastic force of the elastic element 15, and the first magnetic connector 134 and the second magnetic connector 141 make the power supply assembly 14 and the atomizer 13 being electrically connected, so that the elastic element 15 has the elastic potential energy. When the working temperature of the atomizer 13 is higher than the threshold temperature, the attraction force between the first magnetic connector 134 and the second magnetic connector 141 is less than the elastic force of the elastic element 15, and the elastic element 15 releases the elastic potential energy, the atomizer 13 and the power supply assembly 14 being electrically disconnected from each other.

According to the working temperature of the atomizer 13 and threshold temperature, the first magnetic connector 134 and the second magnetic connector 141 make the power supply assembly 14 and the atomizer 13 being electrically connected, or, the elastic element 15 make the atomizer 13 and the power supply assembly 14 being electrically disconnected from each other.

When the temperature of the atomizer 13 is too high, the elastic element 15 of the atomizer 13 make the atomizer 13 and the power supply assembly 14 being electrically disconnected from each other, so that the atomizer 13 cannot work normally, the atomizer 13 is prevented from being heated in dry state or abnormal work.

The above shows only embodiments of the present application, but does not limit the scope of the present application. Any equivalent structure or equivalent process transformation made based on the specification and the accompanying drawings of the present application, applied directly or indirectly in other related arts, shall be included in the scope of the present application.

What is claimed is:

1. An electronic atomization device, comprising:

an atomizer, comprises a first magnetic connector;

a power supply assembly, comprises a second magnetic connector;

an elastic element, located between the atomizer and the power supply assembly;

according to a working temperature of the atomizer, the first magnetic connector and the second magnetic connector make the power supply assembly and the atomizer to be electrically connected, or, the elastic element make the atomizer and the power supply assembly to be electrically disconnected from each other.

2. The electronic atomization device of claim 1, wherein in response to the working temperature of the atomizer is lower than a threshold temperature, the power supply assembly and the atomizer are electrically connected under the attraction force between the first magnetic connector and the second magnetic connector, so that the elastic element has elastic potential energy; in response to the working temperature of the atomizer is higher than or equal to the threshold temperature, the attraction force between the first magnetic connector and the second magnetic connector is less than the elastic force of the elastic element, and the elastic element releases elastic potential energy, so that the atomizer and the power supply assembly are electrically disconnected from each other; or in response to the working temperature of the atomizer is lower than or equal to the threshold temperature, the power supply assembly and the atomizer are electrically connected under the attraction force between the first magnetic connector and the second magnetic connector, so that the elastic element have elastic potential energy; in response to the working temperature of the atomizer is higher than the threshold temperature, the attraction force between the first magnetic connector and the second magnetic connector is less than the elastic force of the elastic element, and the elastic element releases the elastic potential energy, so that the atomizer and the power supply assembly are electrically disconnected from each other.

3. The electronic atomization device of claim 2, wherein the power supply assembly and the atomizer are connected by the attraction force between the first magnetic connector and the second magnetic connector, so that a first electrode connector of the atomizer is in contact with a second electrode connector of the power supply assembly; in response to the working temperature of the atomizer is higher than or equal to the threshold temperature, the attraction force between the first magnetic connector and the second magnetic connector disappears; the elastic potential energy released by the elastic element pushes the atomizer away from the power supply assembly, so that the first electrode connector of the atomizer is separated from the second electrode connector of the power supply assembly, and the atomizer electrically and the power supply assembly are disconnected from each other.

4. The electronic atomization device of claim 1, wherein one end of the power supply assembly configured to connect the atomizer has a first recess, one end of the elastic element is disposed in the first recess, and the other end of the elastic element is in contact with the atomizer.

5. The electronic atomization device of claim 1, wherein one end of the atomizer configured to connect the power supply assembly has a second recess, one end of the elastic element is disposed in the second recess, and the other end of the elastic element is in contact with the power supply assembly.

6. The electronic atomization device of claim 5, wherein the second recess is an air inlet at the bottom of the mounting base of the atomizer.

7. The electronic atomization device of claim 1, wherein the elastic element is a coil spring or a flat spring.

8. The electronic atomization device of claim 1, wherein one of the first magnetic connector and the second magnetic connector comprises magnet, and the other one of the first magnetic connector and the second magnetic connector comprises magnet or iron.

9. The electronic atomization device of claim 1, wherein a material of the first magnetic connector is magnet, and a material of the second magnetic connector is iron.

10. The electronic atomization device of claim 8, wherein the magnet is selected from the group consisting of a samarium cobalt magnet, a neodymium iron boron magnet, and an aluminum nickel cobalt magnet.

11. The electronic atomization device of claim 9, wherein the first magnetic connector extends from an end face of a mounting base of the atomizer configured to connect the power supply assembly to a place near an atomization core of the atomizer.

12. A power supply assembly, comprising:

a second magnetic connector, configured to be connected with a first magnetic connector of an atomizer;

an elastic element, configured to be in contact with the atomizer;

wherein, according to a working temperature of the atomizer, the first magnetic connector and the second magnetic connector make the power supply assembly and the atomizer to be electrically connected, or, the elastic element make the atomizer and the power supply assembly to be electrically disconnected from each other.

13. The power supply assembly of claim 12, wherein in response to the working temperature of the atomizer is lower than a threshold temperature, the power supply assembly and the atomizer are electrically connected under the attraction force between the first magnetic connector and the second magnetic connector, so that the elastic element has elastic potential energy; in response to the working temperature of the atomizer is higher than or equal to the threshold temperature, the attraction force between the first magnetic connector and the second magnetic connector is less than the elastic force of the elastic element, and the elastic element releases elastic potential energy, so that the atomizer and the power supply assembly are electrically disconnected from each other.

14. The power supply assembly of claim 12, wherein in response to the working temperature of the atomizer is lower than or equal to the threshold temperature, the power supply assembly and the atomizer are electrically connected under the attraction force between the first magnetic connector and the second magnetic connector, so that the elastic element have elastic potential energy; in response to the working temperature of the atomizer is higher than the threshold temperature, the attraction force between the first magnetic connector and the second magnetic connector is less than the elastic force of the elastic element, and the elastic element releases the elastic potential energy, so that the atomizer and the power supply assembly are electrically disconnected from each other.

15. The power supply assembly of claim 14, wherein the power supply assembly and the atomizer are connected by the attraction force between the first magnetic connector and the second magnetic connector, so that a first electrode connector of the atomizer is in contact with a second electrode connector of the power supply assembly; in response to the working temperature of the atomizer is higher than or equal to the threshold temperature, the attraction force between the first magnetic connector and the second magnetic connector disappears; the elastic potential energy released by the elastic element pushes the atomizer away from the power supply assembly, so that the first electrode connector of the atomizer is separated from the second electrode connector of the power supply assembly, and the atomizer electrically and the power supply assembly are disconnected from each other.

16. An atomizer, comprising:

a first magnetic connector, configured to be connected with a second magnetic connector of a power supply assembly;

an elastic element, configured to be in contact with the power supply assembly;

wherein, according to a working temperature of the atomizer, the first magnetic connector and the second magnetic connector make the power supply assembly and the atomizer to be electrically connected, or, the elastic element make the atomizer and the power supply assembly to be electrically disconnected from each other.

17. The atomizer of claim 16, wherein in response to the working temperature of the atomizer is lower than a threshold temperature, the power supply assembly and the atomizer are electrically connected under the attraction force between the first magnetic connector and the second magnetic connector, so that the elastic element has elastic potential energy; in response to the working temperature of the atomizer is higher than or equal to the threshold temperature, the attraction force between the first magnetic connector and the second magnetic connector is less than the elastic force of the elastic element, and the elastic element releases elastic potential energy, so that the atomizer and the power supply assembly are electrically disconnected from each other.

18. The atomizer of claim 16, wherein in response to the working temperature of the atomizer is lower than or equal to the threshold temperature, the power supply assembly and the atomizer are electrically connected under the attraction force between the first magnetic connector and the second magnetic connector, so that the elastic element have elastic potential energy; in response to the working temperature of the atomizer is higher than the threshold temperature, the attraction force between the first magnetic connector and the second magnetic connector is less than the elastic force of the elastic element, and the elastic element releases the elastic potential energy, so that the atomizer and the power supply assembly are electrically disconnected from each other.

19. The atomizer of claim 17, wherein the power supply assembly and the atomizer are connected by the attraction force between the first magnetic connector and the second magnetic connector, so that a first electrode connector of the atomizer is in contact with a second electrode connector of the power supply assembly; in response to the working temperature of the atomizer is higher than or equal to the threshold temperature, the attraction force between the first magnetic connector and the second magnetic connector disappears; the elastic potential energy released by the elastic element pushes the atomizer away from the power supply assembly, so that the first electrode connector of the atomizer is separated from the second electrode connector of the power supply assembly, and the atomizer electrically and the power supply assembly are disconnected from each other.

20. The atomizer of claim 16, wherein one end of the power supply assembly configured to connect the atomizer has a first recess, one end of the elastic element is disposed in the first recess, and the other end of the elastic element is in contact with the atomizer; or, one end of the atomizer configured to connect the power supply assembly has a second recess, one end of the elastic element is disposed in the second recess, and the other end of the elastic element is in contact with the power supply assembly.

* * * * *